US006343596B1

(12) United States Patent
Hajji et al.

(10) Patent No.: US 6,343,596 B1
(45) **Date of Patent: *Feb. 5, 2002**

(54) FUEL DELIVERY REGULATOR

(75) Inventors: Mazen A. Hajji, St. Louis; James T. Bellistri, Wildwood, both of MO (US)

(73) Assignee: PC/RC Products, LLC, St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/176,865

(22) Filed: Oct. 22, 1998

Related U.S. Application Data

(60) Provisional application No. 60/062,616, filed on Oct. 22, 1997.

(51) Int. Cl.[7] ..... F02D 41/00
(52) U.S. Cl. ..... 123/676; 123/683
(58) Field of Search ..... 123/676, 683

(56) References Cited

U.S. PATENT DOCUMENTS

| | | | | |
|---|---|---|---|---|
| 3,828,754 A | | 8/1974 | Carlsson | |
| 4,123,901 A | | 11/1978 | Masaki et al. | |
| 4,160,435 A | | 7/1979 | Sleder | |
| 4,296,601 A | | 10/1981 | Martin | |
| 4,305,364 A | | 12/1981 | Stuckas | |
| 4,400,944 A | | 8/1983 | Iwamoto et al. | |
| 4,408,585 A | | 10/1983 | Stuckas | |
| 4,422,427 A | | 12/1983 | Pinson | |
| 4,625,697 A | | 12/1986 | Kosaka | |
| 4,890,593 A | | 1/1990 | Goulet | |
| 4,932,384 A | | 6/1990 | Weingartner | |
| 5,031,593 A | | 7/1991 | Erhard et al. | |
| 5,050,551 A | | 9/1991 | Morikawa | |
| 5,103,791 A | | 4/1992 | Tomisawa | |
| 5,186,133 A | | 2/1993 | Watanabe et al. | |
| 5,278,762 A | | 1/1994 | Kawamura | |
| 5,303,168 A | | 4/1994 | Cullen et al. | |
| 5,588,415 A | | 12/1996 | Ahern | |
| 5,601,068 A | | 2/1997 | Nozaki | |
| 5,771,688 A | | 6/1998 | Hasegawa et al. | |
| 5,813,390 A | | 9/1998 | Anamoto | |
| 5,816,221 A | | 10/1998 | Krueger | |
| 5,829,247 A | * | 11/1998 | Zhang | 123/676 |
| 5,842,459 A | * | 12/1998 | Akagi et al. | 123/676 |
| 5,927,248 A | * | 7/1999 | Lang et al. | 123/676 |
| 5,941,222 A | | 8/1999 | Braly | |
| 6,000,384 A | | 12/1999 | Brown et al. | |

* cited by examiner

*Primary Examiner*—John Kwon
(74) *Attorney, Agent, or Firm*—Polster, Lieder, Woodruff & Lucchesi, L.C.

(57) ABSTRACT

A fuel regulator for two-cycle and/or four-cycle internal combustion engines, particularly those found in model airplanes, comprises a microprocessor, a thermocouple exhaust gas temperature sensor, and a fuel regulating valve installed in a low-pressure fuel delivery system between the fuel tank and the carburetor. During operation, the microprocessor continually receives signals from the exhaust gas temperature sensor. These signals are compared with stored temperature ranges to determine the optimum fuel mixture for the current engine operating conditions. If the current engine operating conditions require a variation in the fuel mixture setting, the microprocessor adjusts the degree of opening of the in-line fuel regulating value, and accordingly regulates the flow of fuel into the carburetor.

30 Claims, 5 Drawing Sheets

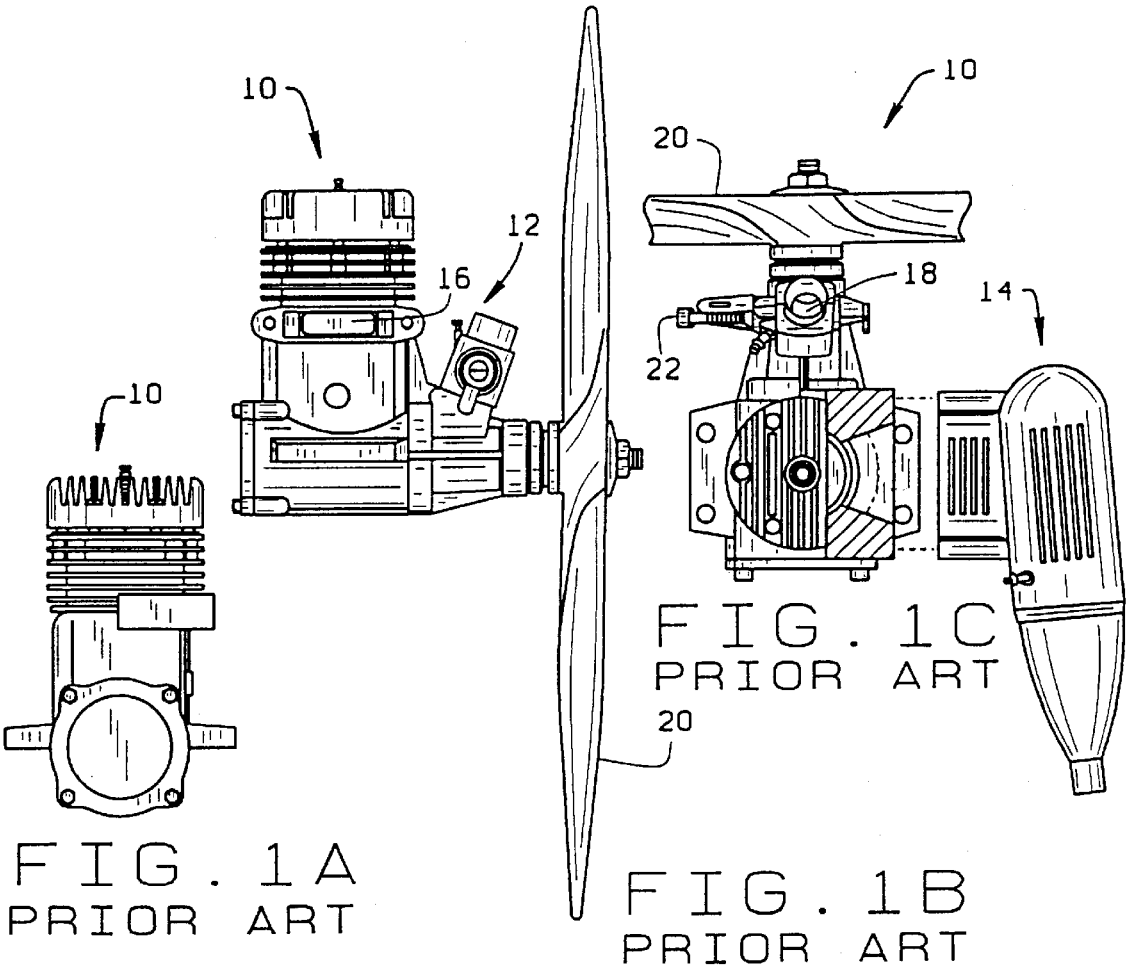
FIG. 1A
PRIOR ART
FIG. 1B
PRIOR ART
FIG. 1C
PRIOR ART
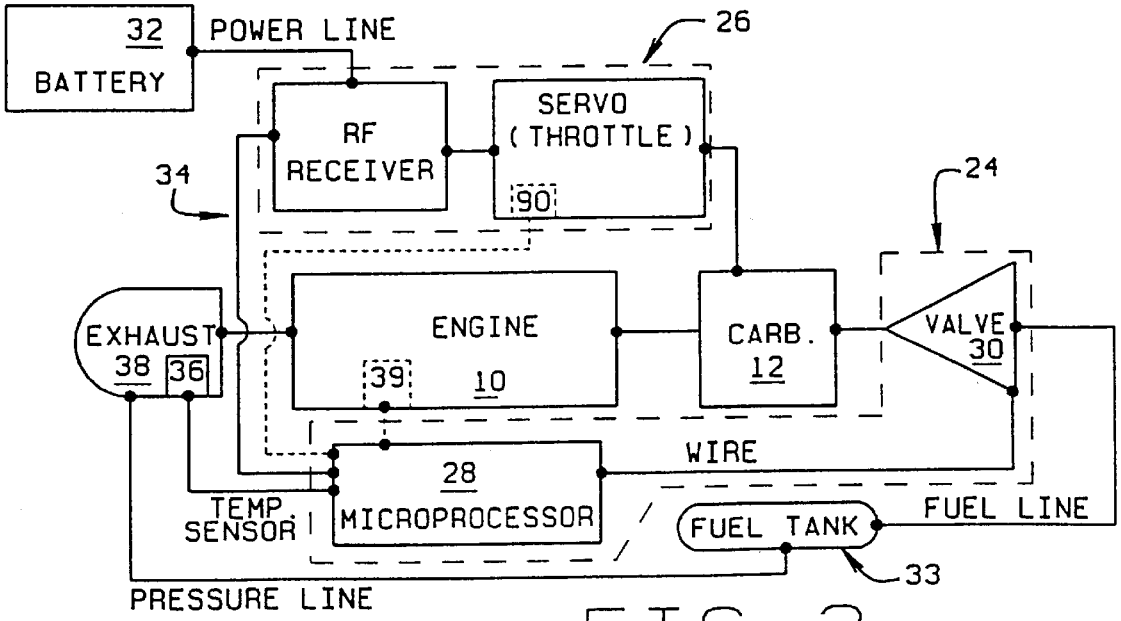
FIG. 2

FUEL DELIVERY REGULATOR

CROSS-REFERENCE TO RELATED APPLICATIONS

This application is based upon provisional U.S. application Serial No. 60/062,616, filed Oct. 22, 1997, upon which priority is claimed.

STATEMENT REGARDING FEDERALLY SPONSORED RESEARCH OR DEVELOPMENT

Not Applicable.

BACKGROUND OF THE INVENTION

This invention relates to a fuel delivery system for two-cycle and four-cycle internal combustion engines, and more particularly, for a feedback fuel regulator for use on model aircraft, comprising a microprocessor, an in-line fuel valve, and one or more engine operating condition sensors including an exhaust gas temperature sensor, to regulate the optimum fuel mixture. While the invention is described in detail with respect to its application in model aircraft engines, those skilled in the art will recognized the wider applications of the inventive principles disclosed hereafter.

A typical model airplane engine 10 (FIGS. 1A–1C) is a single cylinder engine having a very simple carburetor 12 including a fixed bore single air intake venturi and a non-variable fuel jet orifice at a constant throttle valve position, without a fuel bowl for air and fuel intake. The typical engine 10 additionally includes a very simple single-chamber expansion type of muffler 14 connected to the engine exhaust port 16 for handling and muffling exhaust gasses. The air flow through the air intake venturi produces in the venturi throat a partial vacuum which draws fuel into the intake airstream from the engine fuel tank, through the fuel jet. Fuel pressure conventionally is also supplied from the exhaust back pressure, commonly connected to the fuel tank. The carburetor has a throttle valve 18 which is adjustable to regulate air and fuel flow to the engine, and thereby regulate the speed of the engine 10. It is well known in the art that the venturi partial vacuum is rather weak, and results in extremely unreliable engine operation due to variations in aircraft attitude in flight causing variations in fuel head pressure and also due to extremely high centrifugal forces imposed on the aircraft during aerobatics maneuvers, routinely exceeding ten times the gravitational force.

Accordingly, conventional fuel systems fail to produce optimum fuel regulation for maximum power and fuel efficiency. It is known in the art that a doubling in the rate of air intake into a fixed bore single air intake venturi will cause a four-fold increase in venturi partial vacuum fuel draw. This means that at a constant degree of throttle opening in a model aircraft engine, as the engine increases in revolution per minute (rpm) during acceleration, a disproportionately higher amount of fuel than air will be drawn in to the carburetor, causing a rich mixture and inefficient operation. A rich mixture decreases the available torque and limits the engine's power potential as it gains speed. The most efficient way to extract power from a model aircraft engine is to have the engine run at full throttle, turning a large size propeller 20 of low to medium pitch, at the rpm of maximum torque while standing still (static rpm) to achieve good acceleration to in-flight speeds. The in-flight rpm should correspondingly increase to approach the maximum power peak. However, as the engine unloads in-flight, its fuel-air mixture becomes richer than necessary for producing peak power, hence torque and power decrease despite an increase in engine rpm.

Ideally, to compensate for the increased fuel draw during unloaded in-flight operation, a needle valve 22 in the carburetor 12 is adjusted to decrease the needle-valve opening, and correspondingly the fuel flow, for peak power output every time the engine rpm is allowed to increase by reducing the engine load. However, the carburetor needle valve 22 is normally not manually adjustable in a model aircraft while in flight, and must be set at a fixed setting resulting in less than perfect engine operation prior to each flight.

BRIEF SUMMARY OF THE INVENTION

Among the several objects and advantages of the present invention are:

The provision of a new and improved fuel regulator to optimize the fuel mixture for two-cycle and four-cycle engines;

The provision of the aforementioned fuel regulator which eliminates the need to adjust fuel regulating needle valves;

The provision of the aforementioned fuel regulator which is configured for installation between a fuel tank and a carburetor;

The provision of the aforementioned fuel regulator which includes an exhaust gas temperature sensor to continually regulate fuel mixture;

The provision of the aforementioned fuel regulator which is capable of operation under low fuel pressures, in the range of 1–15 pounds;

The provision of the aforementioned fuel regulator which may include additional inputs from engine operating condition sensors and an exhaust gas temperature sensor to continually optimize the fuel mixture; and The provision of the aforementioned fuel regulator which is adapted for use in model aircraft engines.

Briefly stated, the fuel regulator of the present invention comprises a microprocessor, a thermal sensing device, which, in the preferred embodiment is a thermocouple operatively arranged to sense exhaust gas temperature, and an in-line fuel regulating valve installed between the fuel tank and the carburetor. During operation, the microprocessor receives signals from the exhaust gas temperature sensor and any additional engine operating condition sensors. These signals are compared with stored reference valve to determine the optimum fuel mixture for the current engine operating conditions. If the current engine operating conditions require a variation in the fuel mixture settings, the microprocessor regulates the degree and/or rate of opening of the in-line fuel regulating value, and accordingly regulates the flow of fuel into the carburetor.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification:

FIGS. 1A, 1B, and 1C are a rear view, a side view, and a top-down view respectively of a typical two-cycle model aircraft engine and muffler combination. FIG. 1C has a part of the engine cut away at line A–A';

FIG. 2 is a diagrammatic illustration of the interconnecting components of the fuel regulator of the present invention;

Corresponding reference numerals indicate corresponding parts throughout the several figures of the drawings.

DETAILED DESCRIPTION OF THE INVENTION

Figure 3:
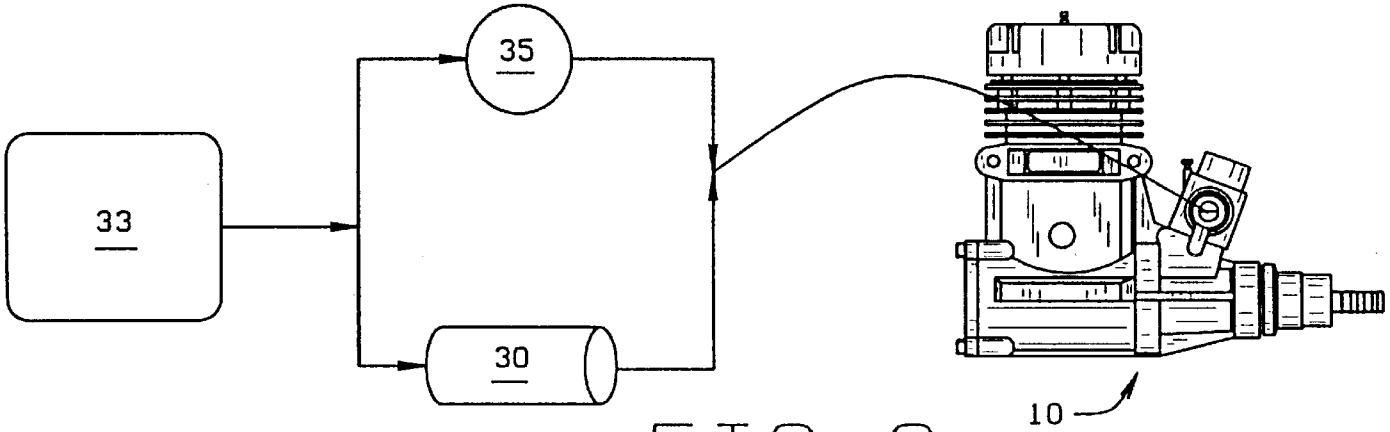
FIG. 3 is an diagrammatic illustration of a parallel fuel flow circuit.

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Referring now to FIG. 2, the various components of the fuel regulator 24 of the present invention are shown interconnected with the engine 10 and flight control system 26 of a typical model aircraft. The main components of the fuel regulator 24 are a microprocessor 28 and an in-line fuel regulator valve 30, preferably driven by a pulse width modulated signal controlled by the microprocessor. The microprocessor 28 is powered by an external power source, preferably the same battery power source providing power to the flight control systems 26, but may be powered independently. Typically the flight control system 26 receives electrical power from an on-board battery 32, in which case a power lead 34 is connected to the microprocessor 28.

The in-line fuel regulator valve 30 is preferably a solenoid valve, with the degree of opening controlled by a pulse width modulated signal sent from the microprocessor 28, and is capable of operating under either vacuum or slight pressure conditions. The preferred operating condition for the fuel-regulator value is with a low fuel pressure, i.e., on the order of 1–15 pounds of pressure. Fuel line pressure may be generated by a fuel pump, exhaust gas pressure, or by engine delivered pressure. Other delivers methods, including the traditional venturi vacuum draw, are compatible with the broader aspects of our invention.

Those skilled in the art also will recognize that numerous other types of fuel regulator valves, including multiple, variable-orifice, butterfly, ball, and gate valves may be employed, including valves employing control signals other than pulse width modulation. Additionally, to allow for precise fuel flow control, a parallel fuel flow circuit shown in FIG. 3 may be included wherein only a portion of the fuel flowing from the fuel tank 33 into the engine 10 is regulated by the fuel regulator valve 30, with the remainder continually flowing directly to the engine 10. For example, if the capacity of fuel regulator valve 30 is capable of accurately controlling 20% of the fuel flow to the engine 10, 80% of the fuel will be routed to the engine through a parallel fuel line and a fixed valve 35, and only 20% metered through the fuel regulator valve 30.

Figure 4:
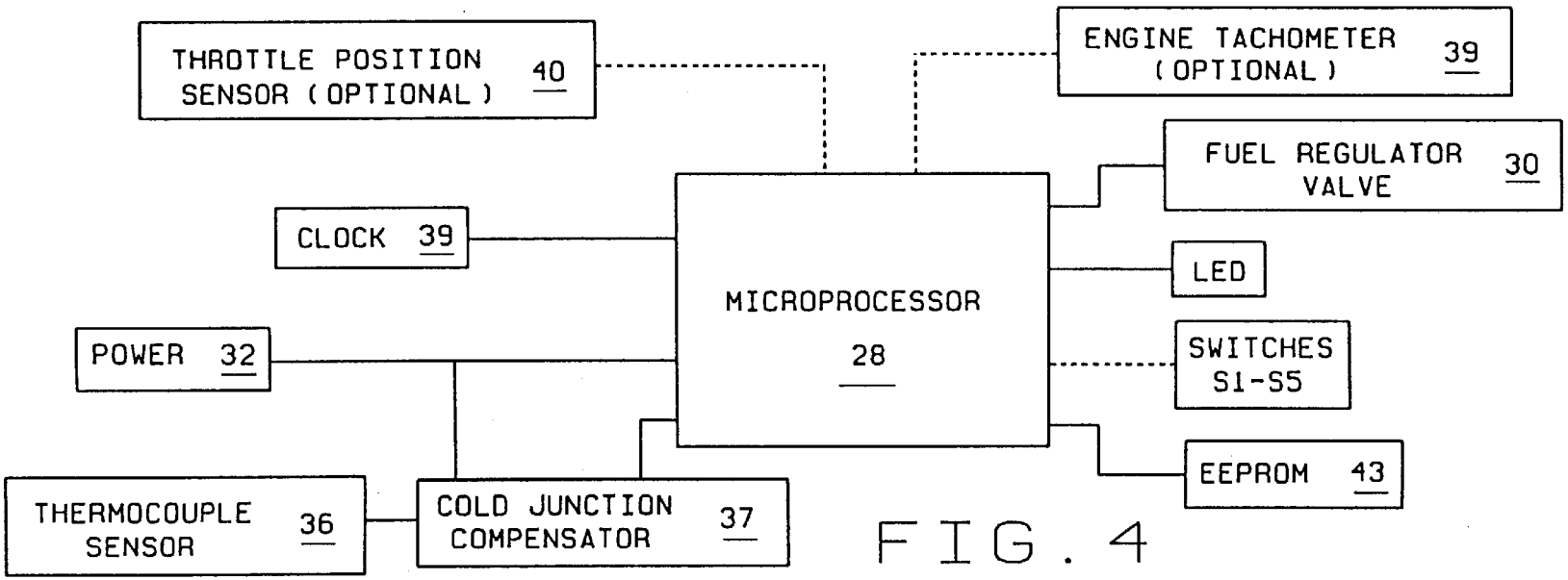
FIG. 4 is a diagrammatic illustration of the electronic components interconnected to the fuel regulator microprocessor shown in FIG. 2.

To determine the optimum fuel mixture, the microprocessor 28 receives input signals representative of the current operating conditions of the engine 10. A temperature sensor 36 placed in the exhaust system 38 of the engine 10 provides the microprocessor 28 with an indication of the current exhaust gas temperature (EGT). The temperature sensor 36 is preferably a conventional thermocouple sensor, adapted for operation within the temperature range encountered in exhaust gases, i.e. from room temperature through about 1500° F. As is seen in FIG. 4, appropriate conventional circuitry 37 is included with the thermocouple sensor 36 to compensate for any cold junction temperatures that may be encountered during engine operation. Additionally, a convention clock circuit 39 is provided.

Those skilled in the art will recognize that additional engine operating condition sensors, such as an engine tachometer 39 or a throttle position sensor 40 interconnected with the throttle control element 42 of the flight control system 26 may be utilized in conjunction with the temperature sensor 36 to provide the microprocessor 28 with an indication of the current operating conditions of the engine 10. Signals, such as those corresponding to the engine speed, or high and low throttle positions for the particular engine 10 to which the fuel regulator 28 is connected, are stored in an long-term memory 43, typically a conventional EEPROM or other non-volatile memory device compatible within the broader aspects of the invention.

In the preferred embodiment, the conventional EEPROM 43 additionally stores preprogrammed modes of operation for the microprocessor 28, corresponding to different engines to which the system is connected, different EGT ranges, and corresponding fuel regulator valve settings. Each operational mode stored in the EEPROM 43 is optimized for the specific characteristics of a brand or model of engine. Those skilled in the art will recognize that alternate embodiments, as shown in FIG. 4, may employ a number of input selecting devices, such as switches, S1–S5, for selecting a mode of operation. The selection of switches S1–S4 in combination select one of sixteen sets of operating parameters for the fuel regulator 28. These operating parameters may include the initial fuel regulating valve 30 opening, and the ideal operating temperature range. As will be described below, the selection of switch S5 places the fuel regulator 28 into a configuration mode wherein parameters may be entered and stored, for example, corresponding to the "low" or "neutral" and "high" or "open" throttle positions. Other embodiments may utilize a fewer or a greater number of selecting devices which may take forms other than the switches illustrated.

Figure 5:
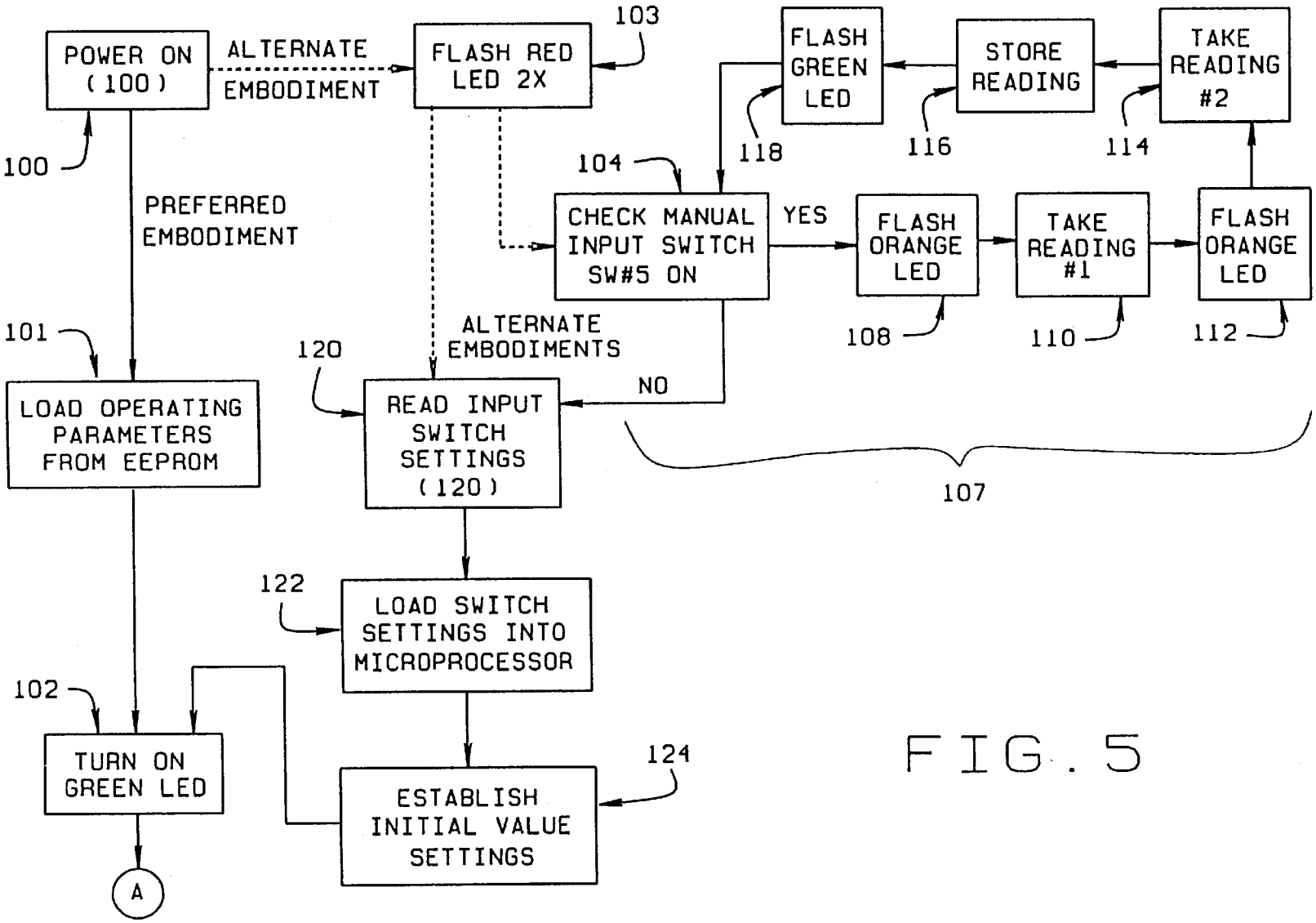
FIG. 5 is a flow chart illustrating the steps traversed by the microprocessor employed in the fuel regulator shown in FIG. 2 during a startup sequence.

Referring next to FIG. 5, a flow chart is shown of the steps traversed by the microprocessor 28 employed in the embodiment of FIGS. 2 and 4. Upon initial power-up (Block 100), the preferred embodiment retrieves the operating parameters from EEPROM storage 43 and transfers them to the microprocessor 28 (Block 101), a signal is provided to the operator (Block 102) that the fuel regulator system 24 is operational and is ready to being regulating the fuel mixture flowing to the engine 10. This signal is preferably provided by flashing a green colored light emitting diode LED controlled by the microprocessor 28.

In alternate embodiments employing input selecting devices, such as switches, S1–S5, the microprocessor 28 follows the alternative manual startup sequence indicated in FIG. 5. After powerup (Block 100), a signal is provided to the operator, preferably by flashing a red light emitting diode (Block 103), indicating that the system is ready to receive operator input. If provided, the system next checks the status of the manual input switch S5 (Block 104). If switch S5 is in the "on" position, the microprocessor 28 begins a configuration cycle (Block 107). In the embodiment shown, the configuration cycle corresponds to the input of throttle position information, wherein a low and a high throttle position readings are taken from the optional throttle position sensor 40 and stored. As described above, the configuration cycle 107 may include steps corresponding to the input of other operating parameters, such as minimum and maximum engine speeds.

During the illustrated configuration cycle, the microprocessor signals the operator to place the throttle in the "low" or "neutral" position (Block 108). This signal is preferably provided by flashing a colored light emitting diode of a different color than the power-up signal (Block 102). The microprocessor 28 then reads a first signal from the throttle position sensor 40 (Block 110) and stores the value in an internal register. Next, the microprocessor 28 signals the operator (Block 112) to place the throttle in the "high" or "open" position. A second signal reading is taken from the throttle position sensor 40 (Block 114) and the value stored in a second internal register. Upon storing both values in internal registers, the microprocessor 28 copies the values to a long-term storage device (Block 116) such as EEPROM 43 or other suitable non-volatile device. Finally, upon completion of the storage step (Block 116), the microprocessor 28 again signals the operator (Block 118), indicating the configuration cycle is complete, and returning to the switch status check (Block 104). Those skilled in the art will readily recognize that similar configuration cycles may be employed to input other information into the microprocessor, for example, indicating high and low values for engine revolutions per minute.

If switch S5 is not selected, or is not included in the embodiment, the microprocessor determines which of switches S1–S4 are in an "on" position (Block 120) to load the initial operating parameters (Block 122) of the in-line fuel regulator valve 30 for startup of the engine 10 and the nominal temperature range for optimum performance. The fuel regulator valve 30 is then opened (Block 124) to the appropriate setting, and a signal is provided to the operator (Block 102) that the microprocessor 28 is ready to being regulating the fuel mixture flowing to the engine 10.

Figure 6:
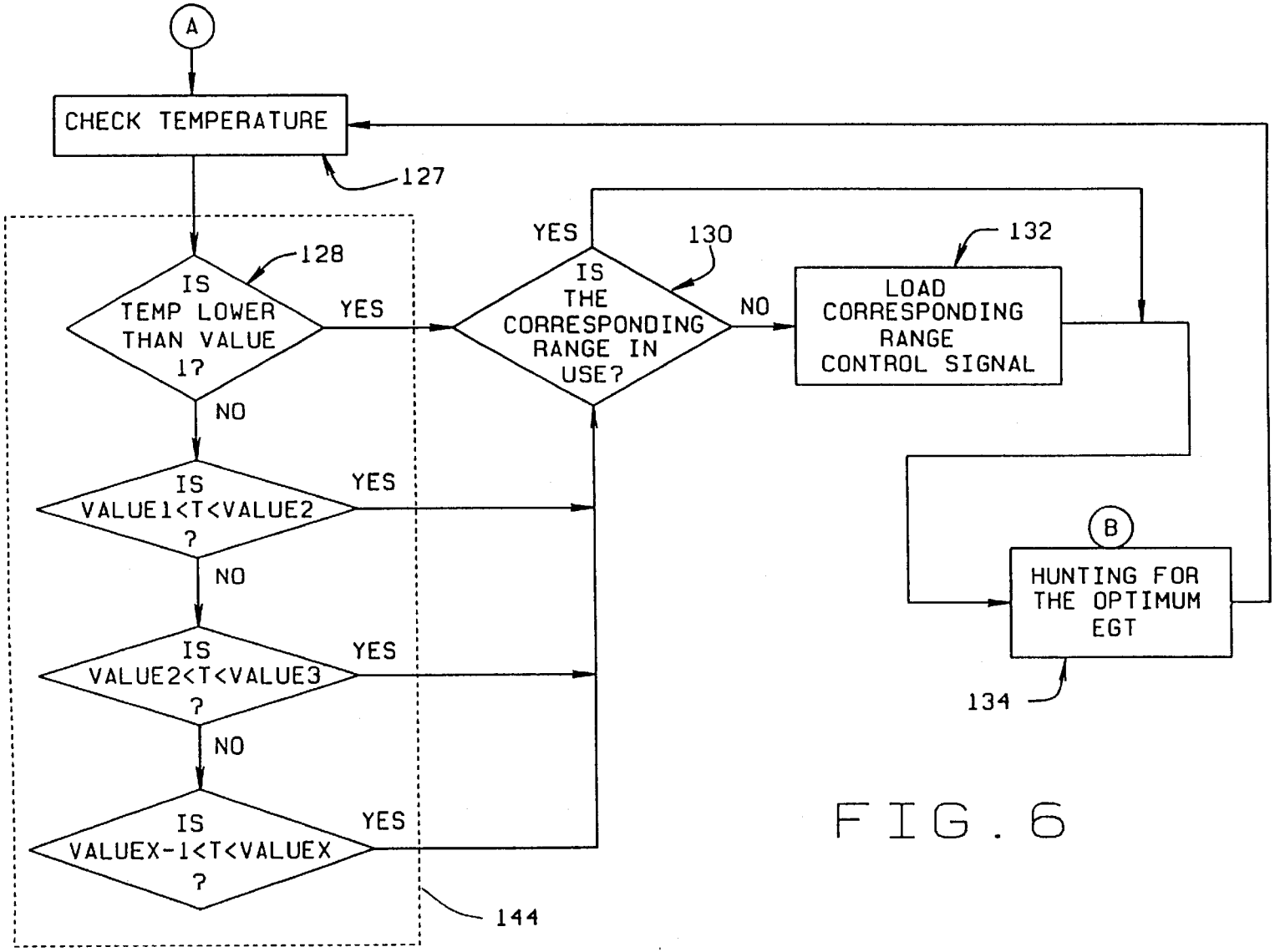
FIG. 6 is a flow chart illustrating the steps in the cyclic fuel regulation operation performed by the microprocessor shown in FIG. 2 during engine operation.

As shown in FIG. 6, the regulation of the fuel mixture during engine operation is performed as a closed loop procedure which includes a "hunting" cycle to locate the optimum fuel mixture within a predetermined EGT range. The microprocessor 28 receives a signal from the exhaust gas temperature sensor indicative of the current exhaust gas temperature (Block 127) and compares it with a predetermined upper value for the lowest operating temperature range stored in memory, for example: 450° F., (Block 128). If the exhaust gas temperature is lower than the upper range value, the microprocessor 28 next determines if the temperature is within the temperature range currently in-use (Block 130). If the temperature is not within the temperature range currently in use, the microprocessor loads the appropriate temperature range containing the current EGT and the corresponding fuel regulator valve 30 initial control setting from the EEPROM (Block 132). Once the appropriate temperature range and fuel regulator control settings are loaded from the EEPROM, or if the temperature range is already loaded, the microprocessor begins hunting for the optimum EGT within the current temperature range (Block 134).

Figure 7:
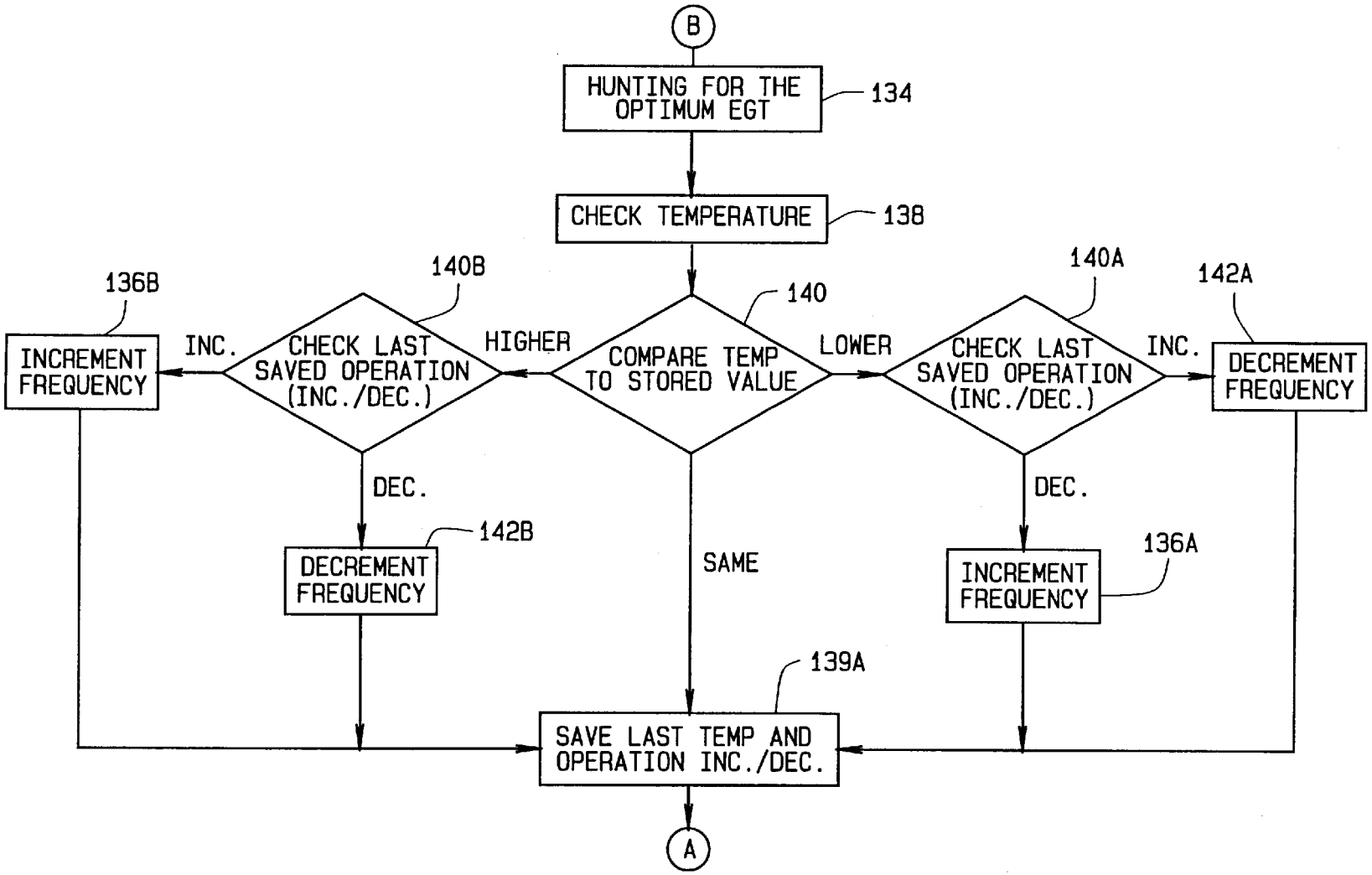
FIG. 7 is a flow chart illustrating the steps in the cyclic fuel regulation operation performed by the microprocessor shown in FIG. 2 during the optimum EGT hunting.

As shown in FIG. 7, the microprocessor 28 begins hunting (block 134) for the optimun EGT by checking the present temperature (Block 138) and compares it with the previous temperature, for example, 0° at startup. The microprocessor 28 then decides whether the present temperature is higher, lower, or the same as (Block 140) the previous temperature. The microprocessor 28 then checks for the last operational command, for example, decrement at start up (Block 140 A or B). If the temperature is higher (Block 140B), and the last operation was decrement, the microprocessor 28 will decrement again (Block 142B). If the temperature was higher (Block 140B), and the last operation was increment, the processor will increment again (Block 136B). If the temperature is found to be lower (Block 140A), and the last operation was decrement, the processor will increment (Block 136A). If the temperature was lower and the last operation was increment, the processor will decrement (Block 142A). If the present temperature (Block 138) is found to be the same as the previous temperature, the microprocessor 28 neither increments nor decrement. Then the microprocessor 28 stores the present temperature and the result of its decision to increment or decrement as last temperature and operation respectively (Block 139A). The microprocessor then returns to the main loop FIG. 6, and repeats the cycle.

By continually cycling through hunting operation steps outlined above, the microprocessor 28 of the fuel regulator 24 is capable of properly adjusting the fuel mixture to a wide variety of operating conditions for the engine 10 by regulating the opening of the fuel regulator valve 30. In the alternative, a check of additional engine operating condition sensors, such as the tachometer 39 or throttle position sensor 40 may be incorporated into the fuel regulation cycle, if desired, and may take precedence over the EGT ranges described above.

For example, if the throttle position is within the nominal range selected, for example 95–100%, the microprocessor 28 receives a signal from the throttle position sensor indicative of the current throttle position and compares it with a predetermined value stored in memory, for example 95–100%. If the throttle position sensor signal is lower than the upper range value, the microprocessor 28 next determines the last operation, i.e., increment or decrement. The hunting process continues as described above, the object being to drive the throttle position to maximum en-leanment. As indicated, maximum en-leanment is delivered by the method described above, regardless of the condition being monitored. As will be appreciated, while this alternate embodiment operates in a relatively small throttle opening range, other alternate embodiments may operate over a full range of throttle openings or be responsive to engine speed in addition to EGT.

Those skilled in the art will see that the low pressure fuel regulator of the present invention provides a significant improvement over the prior art in terms of reaching and maintaining optimum engine performance levels utilizing an exhaust gas temperature sensor. Although described in connection with model airplane engines, it should be noted that the various embodiments and ramifications discussed herein may be applicable to small-sized internal combustion engines of all types, including those employing multiple combustion cylinders.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense. In that regard, numerous variations will be apparent to those skilled in the art in view of that description. Merely by way of example, ranges given for microprocessor operation may be varied. Likewise, other input information to the microprocessor may be used. The microprocessor itself may vary or take other forms. The application of the invention to internal combustion engines besides model airplane motors is particularly relevant. These variations are merely illustrative.

What is claimed is:

1. For use in combination with an internal combustion engine having an fuel supply system, a throttle, an exhaust system, and a fuel regulator for the engine, comprising:

a plurality of sensors configured to generate signals indicating the operating condition of said engine, at least one of said signals being indicative of exhaust gas temperature;

a control valve in the fuel supply system, said control valve regulating the flow of fuel through the fuel system; and a control unit for controlling operations of the engine at all times and speeds, said control unit receiving said signals, said control unit actuating said control valve in response to said received signals, said control unit continually without intermission readjusting the flow settings based on said signals, thereby attempting to achieve optimal performance for said internal combustion engine for any operating condition thereof during the entire time of engine operation.

2. The combination of claim 1 wherein said exhaust gas temperature sensor is a thermocouple device.

3. The combination of claim 2 wherein said throttle position sensor generates a signal indicative of the position of said throttle for throttle positions at and between a low/neutral position and an high/open position.

4. The combination of claim 3 wherein said control unit stores the signal indicative of said low/neutral throttle position and said signal indicative of said high/open throttle position.

5. The combination of claim 4 wherein said signals are stored in a memory device.

6. The combination of claim 5 wherein the memory device is an EEPROM.

7. The combination of claim 1 wherein said control unit stores a plurality of sets of optimal engine operating conditions, each set of optimal engine operating conditions including an optimal engine operating temperature range.

8. The combination of claim 7 further comprising a plurality of switches connected to said control unit, said control unit selecting one set of said plurality of sets of optimal engine operating conditions responsive to the respective positions of said plurality of switches.

9. The combination of claim 8 wherein said control unit actuates said control valve responsive to said received signals and said selected set of optimal engine operating conditions.

10. The combination of claim 9 wherein said control unit opens said control valve responsive to said engine operating in said optimal temperature range and said throttle position sensor indicating approximately 95% throttle opening.

11. The combination of claim 9 wherein said control unit restricts said control valve responsive to said engine operating below said optimal temperature range and said throttle position sensor indicating less than approximately 90% throttle opening.

12. The combination of claim 9 wherein said control unit opens said control valve responsive to said engine operating above said optimal temperature range.

13. A method of regulating fuel mixture flow to an internal combustion engine having a fuel system, an exhaust system, and an adjustable throttle, the method comprising the steps of:

determining continuously the temperature of combustion gases exiting said internal combustion engine through said exhaust system;

selecting a nominal fuel mixture flow setting corresponding to said determined temperature falling within a predefined temperature range;

adjusting a fuel mixture regulator valve to achieve said nominal fuel mixture flow setting;

operating said engine;

continuously operating the engine from engine start up by adjusting said fuel mixture flow settings both upwardly and downwardly as required to achieve optimal performance from said engine by observing fluctuations in said exhaust gas temperatures; and continuously readjusting the flow setting both upwardly and downwardly to achieve optimal performance from said engine based on the exhaust gas temperatures so as to control engine operation by such flow settings during the entire time of engine operation.

14. The method of regulating fuel mixture flow as set forth in claim 13 wherein selecting the initial fuel mixture flow settings includes the step of actuating a selecting device.

15. The method of regulating fuel mixture flow as set forth in claim 13 wherein said selecting device is a plurality of switches.

16. The method of regulating fuel mixture flow as set forth in claim 13 wherein adjusting said fuel mixture flow settings to achieve optimal performance from said engine further includes the steps of:

sensing continually the position of the adjustable throttle;

selecting continually an ideal setting for said fuel mixture regulator valve responsive to said sensed exhaust gas temperature and said throttle position; and setting said fuel mixture regulator valve to said ideal setting.

17. The method of regulating fuel mixture flow as set forth in claim 16 wherein the step of sensing continually the temperature of gases flowing through the exhaust system is performed by a thermocouple.

18. The method of regulating fuel mixture flow as set forth in claim 16 wherein the step of selecting continually an ideal setting for said fuel mixture regulator valve is performed by a microprocessor.

19. A fuel regulator system for use in combination with an internal combustion engine having a low-pressure fuel supply system, and an exhaust system, comprising:

a fuel flow control device disposed in said fuel supply system, said fuel flow control device adjusting the flow of fuel from said fuel supply system to said internal combustion engine;

a microprocessor for controlling operations of the engine at all times, said microprocessor being operatively connected to said fuel control device, said microprocessor regulating said fuel flow control device;

an exhaust gas temperature sensor disposed within said exhaust system, said exhaust gas temperature sensor providing an indication of exhaust gas temperatures to said microprocessor; and said microprocessor regulating said fuel flow device responsive to said exhaust gas temperature indication falling within at least one predetermined range by continuously adjusting by incrementing and decrementing fuel delivery from engine start up so as to arrive at the most efficient operating condition of said engine and to control engine operation during the entire time of that operation.

20. The fuel regulator system of claim 19 wherein said fuel flow control device is a solenoid valve.

21. The fuel regulator system of claim 19 wherein said microprocessor regulates said fuel flow control device with a pulse-width modulated signal.

22. The fuel regulator system of claim 19 further including a throttle position sensor disposed in said fuel supply system, said throttle position sensor providing an indication of throttle position to said microprocessor; and said microprocessor additionally regulating said fuel flow control device in response to said throttle position indication.

23. The fuel regulator system of claim 19 further including a engine tachometer disposed in said fuel supply system, said engine tachometer providing an indication of engine revolution speed to said microprocessor; and said microprocessor additionally regulating said fuel flow control device in response to said engine revolution speed indication.

24. The fuel regulator system of claim 19 wherein said fuel flow control device is adapted to operate under pressure ranging from a vacuum to a low positive pressure.

25. The fuel regulator system of claim 24 wherein said low positive pressure is between 0 and 30 pounds.

26. The fuel regulator system of claim 19 wherein said fuel flow control means comprises:

a first fuel flow path between said fuel supply system and said internal combustion engine;

a second fuel flow path between said fuel supply system and said internal combustion engine; and a valve means disposed in said second fuel flow path, said valve means regulating the flow of fuel through said second fuel flow path in response to signals from said microprocessor.

27. The fuel regulator system of claim 26 wherein said first fuel flow path has a maximum fuel flow capacity less than the maximum fuel draw capacity of said internal combustion engine, and said second fuel flow path has a maximum fuel flow capacity equivalent to the difference between said first flow path capacity and said draw capacity of said internal combustion engine.

28. The fuel regulator system of claim 19 wherein said microprocessor adjusts said fuel flow control device to maximize said exhaust gas temperatures.

29. The fuel regulator system of claim 28 wherein said microprocessor operates so as to increase and decrease the flow of fuel through said fuel flow control device in response to said exhaust gas temperatures to obtain a desired operating condition.

30. A method of regulating fuel delivery to an internal combustion engine through a fuel regulating valve comprising the steps of:

(a) starting the engine;

(b) setting a desired speed condition for the engine through the fuel regulating valve;

(c) observing an exhaust gas temperature of combustion byproducts exiting said internal combustion engine;

(d) observing whether the last operation conducted on the fuel regulating valve was an increment or a decrement for fuel flow through the valve;

(e) incrementing fuel flow if the temperature is higher and the last operation was an increment;

(f) decrementing fuel flow if the temperature is higher and the last operation was a decrement;

(g) incrementing fuel flow if the temperature is lower and the last operation was a decrement;

(h) decrementing fuel flow if the temperature is lower and the last operation was an increment;

(i) maintaining the same fuel delivery to said internal combustion engine through said fuel regulating valve in response to said exhaust gas temperature remaining unchanged; and (j) continuing the use of exhaust gas temperature as a control to operate the internal combustion engine at all operating conditions of the internal combustion engine and to control engine operation during the entire time of that operation.

* * * * *